United States Patent [19]

Andreoli

[11] Patent Number: 4,463,688

[45] Date of Patent: Aug. 7, 1984

[54] GRATE BLOCK FOR A REFUSE INCINERATION GRATE

[75] Inventor: Bruno Andreoli, Uerikon, Switzerland

[73] Assignee: Von Roll AG., Gerlafingen, Switzerland

[21] Appl. No.: 485,290

[22] Filed: Apr. 15, 1983

[30] Foreign Application Priority Data

May 13, 1982 [CH] Switzerland ..... 2999/82

[51] Int. Cl.[3] ..... F23H 3/00

[52] U.S. Cl. ..... 110/298; 110/278; 110/281; 126/163 R; 126/174

[58] Field of Search ..... 110/268, 278, 279, 280, 110/281, 285, 286, 291, 298, 299, 328; 126/152 B, 174, 175; 266/178, 179, 180; 414/173, 174, 178; 432/239

[56] References Cited

U.S. PATENT DOCUMENTS 2,431,799 12/1947 Gaffney ..... 110/328
2,745,364 5/1956 Martin ..... 110/298
4,018,168 4/1977 Andreoli et al. ..... 126/174
4,103,627 8/1978 Mainka ..... 110/298
4,314,541 2/1982 Martin et al. ..... 110/281

*Primary Examiner*—Edward G. Favors
*Assistant Examiner*—Steven E. Warner
*Attorney, Agent, or Firm*—Roylance, Abrams, Berdo & Goodman

[57] ABSTRACT

An improved grate block includes a blow-out channel terminating at a blow-out opening through the face of the block, the opening having pre-determined dimensional relationships with respect to the size of the front face of the block. The ratio of the width to the height of the front face is smaller than the ratio of the width to the height of the blow-out opening, and one-half the area of the front face is between 20 and 40 times larger than the cross-sectional area of each blow-out opening. Additionally, the blow-out openings are arranged above the horizontal center line and laterally spaced from the vertical center line through the front face, the channel sloping at an angle relative to the upper surface of the grate block which lies between about 15° and about 25°.

16 Claims, 14 Drawing Figures

FIG. 1a
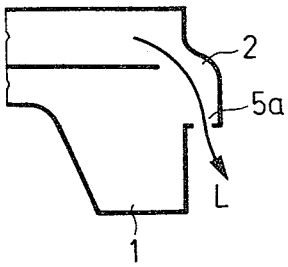
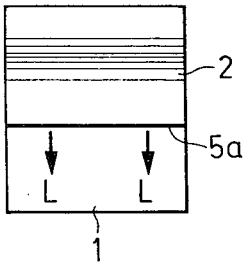
FIG. 1b
FIG. 1c
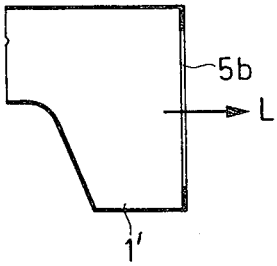
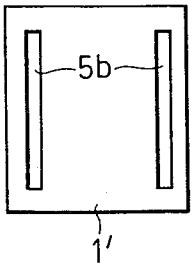
FIG. 1d
FIG. 1e
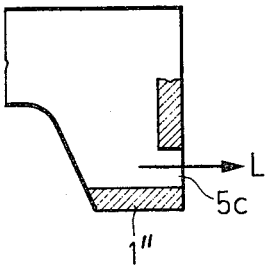
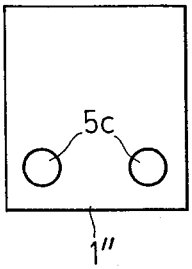
FIG. 1f
FIG. 1g
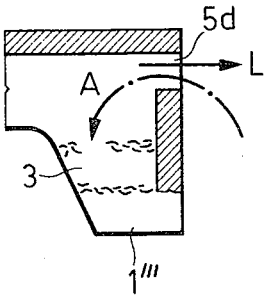
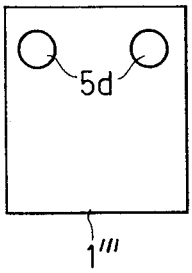
FIG. 1h
PRIOR ART

| | | | |
|---|---|---|---|
| $Z_{11}$ | . . | . . | $Z_{14}$ |
| ⋮ | $Z_{22}$ | | ⋮ |
| ⋮ | | $Z_{33}$ | ⋮ |
| $Z_{41}$ | . . | . . | $Z_{44}$ |

| | | |
|---|---|---|
| $Y_{11}$ | . . | $Y_{13}$ |
| ⋮ | $Y_{22}$ | ⋮ |
| $Y_{31}$ | . . | $Y_{33}$ |

GRATE BLOCK FOR A REFUSE INCINERATION GRATE

This invention relates to a grate block which can be used in conjunction with similar blocks to form a grate layer in a refuse incinerator with the grate blocks being arranged in partially overlapping, roofing tile-like manner with respect to one another on a grate frame which is inclined to the horizontal.

BACKGROUND OF THE INVENTION

As a result of changes in the composition of refuse or garbage over the last few years, and particularly due to the increase in caloric value of such material, the combustion grate is exposed to high thermal stresses, particularly certain individual portions thereof. Due to the dual function of the combustion grate as a combustion support with ventilating means and also as a transfer or conveyance means for the material to be burned, the grate structure often includes such features as alternating fixed and movable grate sections and is a relatively complex multi-part structure. In addition, because such a combustion grate is part of a control loop and is expected to have an appropriately rapid response to a control signal, its dynamics must have a certain minimum degree of precision. Thus, boundary conditions must be insured in which the combustion grate can operate in a reliable manner, partly by special interventions to prevent the equilibrium which commonly occurs.

One of a large number of important boundary conditions is the grate temperature. The specific control intervention involves establishing combustion temperature control such that the average temperature of the grate layer does not exceed 300° C. with a combustion temperature of, for example, 1000° C.

It is well recognized that local overheating of the grate layer due to heat accumulation leads to increased corrosion and an increased scale formation rate and, finally, to the complete destruction of parts of the grate layer within a relatively short time. These grate layer parts must be replaced and, thus, interchangeability is desired and is achieved by various structural arrangements.

One preventative measure for preventing high corrosion or scaling rates and increased mechanical wear which leads to the premature destruction of larger units is provided by the forced cooling of the grate layer. Almost without exception, part of the cooling air is additionally used as the primary combustion air in the prior art. Thus, the control of the primary combustion air is also a temperature control measure.

For forced cooling purposes, the undergrate blast generally flows against the grate layer and air passage openings in the layer allow part of the cooling medium to pass into the refuse bed to be burned where it participates in the combustion process as the primary combustion air. Clogging of the air openings leads to reduced flow and increased back pressure in the cooling air path and, consequently, to accumulation of heat at the particular point of the grate layer. This leads to thermal overstressing of the grate part, increased wear, higher scaling rates and, within a short time, to the destruction of the grate part.

BRIEF SUMMARY OF THE INVENTION

An object of the present invention is to provide an improved grate block, usable in conjunction with similar grate blocks, which has an improved air passage arrangement which avoids degradation of the air passageways and thus continues to perform its function with clear passageways for the cooling and combustion air.

Briefly described, the invention includes an improved grate block for use with other similar blocks in a grate layer of a refuse incineration system. The blocks are arranged in partially overlapping, roof tile-like manner on an inclined grate frame, and the system has means for supplying and removing forced air for cooling and for providing primary combustion air. The improved block comprises a front, generally rectangular, planar face having length and width dimensions $L_1$ and $L_2$ where $L_1$ is equal to or greater than $L_2$. The block also has a plurality n of blow-out channels for conducting the forced air from within the block to the outside thereof, each of said channels terminating in a generally rectangular opening through the front face, each opening having length and width dimensions $d_1$ and $d_2$ where $d_1$ is equal to or greater than $d_2$. The dimensions of the openings are selected such that the face area F and each opening cross-sectional area f are related in accordance with the expressions:

$$L_1:L_2 < d_1:d_2$$

and $$20 \leqq (n/2)F:nf \leqq 40,$$

i.e., the ratio of the dimensions of the face is smaller than the ratio of the dimensions of each opening, and the ratio of half the face area to an opening area is between 20 and 40.

In order that the manner in which the foregoing and other objects are attained in accordance with the invention can be understood in detail, particularly advantageous embodiments thereof will be described with references to the accompanying drawings, which form a part of this specification and wherein:

FIGS. 1*a*–1*h* are schematic side and front elevation drawings of prior art structures exhibiting problems which are overcome by the present invention;

FIG. 2 is a partial side elevation, in partial section, illustrating grate blocks in accordance with the invention assembled in a grate layer;

FIG. 3*a* is a front elevation of a grate block in accordance with the invention;

FIG. 3*b* is a side elevation, in section, along line 3*b*—3*b* of FIG. 3*a;*

FIG. 4*a* is a simplified front elevation of a grate block in accordance with the invention illustrating dimensional relationships thereof; and FIGS. 4*b* and 4*c* are diagrams of the front face of a grate block showing subdivisions thereof useful in positioning air passage openings therein.

DETAILED DESCRIPTION OF PREFERRED EMBODIMENTS

Figure 2:
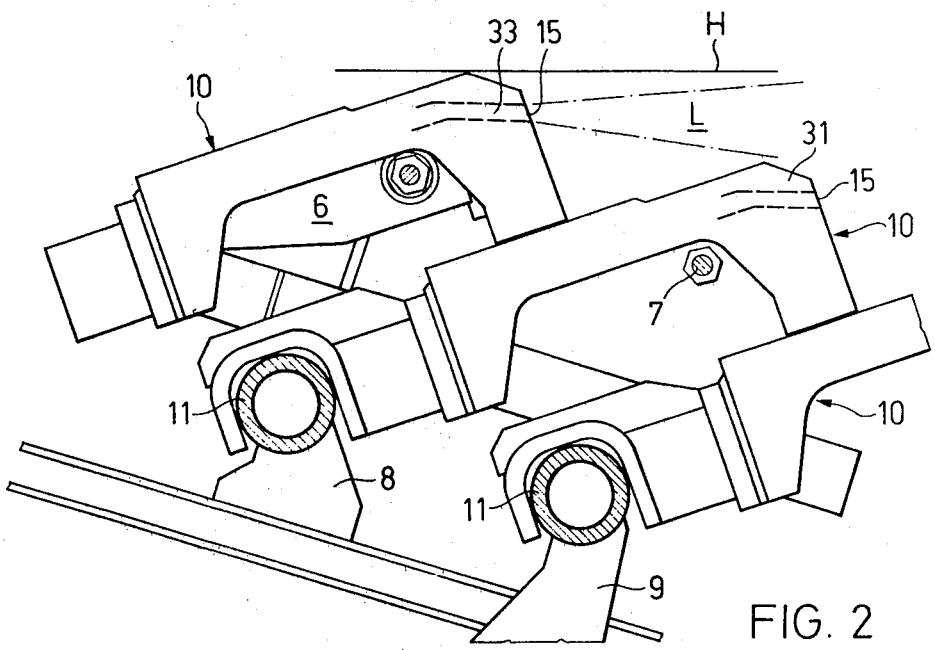

Before entering into a discussion of the invention, it may be helpful to discuss certain solutions which have been previously attempted and which have demonstrated certain shortcomings. For this purpose, FIGS.

1a–1h are provided, schematically illustrating air passage arrangements in grate blocks, only the front end of each block being illustrated. In each of these four prior art structures, a schematic side elevation and front elevation are shown. In each case, the arrow L symbolizes the general path of the outflowing air through air passage openings 5a through 5d. In the embodiments of FIGS. 1a–1d, the air openings 5a, 5b are constructed as slots and in the embodiments shown in FIGS. 1e–1h, the openings are in the form of circular passages. Each of these represent arrangements and shapes which have been used in practice, but none of them have been successful.

The structure shown in FIGS. 1a and 1b includes a nose-like projection 2 which extends across the entire width of the front face of the grate block. Across the bottom of the projection 2 is a slot-like opening 5a. Part of the cooling air flow L reaches the slot-like opening 5a by means of a system of air guidance elements, not shown, and passes out of the slot in a direction which is substantially parallel with the front face of the block 1. As will be understood, each of these blocks is intended to be assembled with other similar blocks in generally the same fashion as the blocks of the present invention, shown in FIG. 2, wherein each of the grate blocks is arranged so that it partially overlaps an adjacent block, forming an arrangement which is similar to the overlapping arrangement of roof tiles. In the embodiment of FIGS. 1a, 1b, the outflowing air directly strikes the upper part of the adjacent underlying grate block. The burning refuse bed above the grate layer distributes the air stream, but in the vicinity of the air opening localized overheating increasingly leads to caking and clogging so that the opposite edges of the slot-like opening slowly "grow together". At this point, there is local failure of the temperature control and overheating rapidly leads to scale formation.

In order to obviate this problem, primary combustion air was prevented from directly flowing against either the same or an adjacent grate block by employing the technique shown in FIGS. 1c and 1d. The flow is directed so that it emerges generally at an angle of about 90° from the front face of the grate block. Two slot-like air outlets 5b, which are perpendicular to the slot of the first structure, now make it possible to directly blow the cooling air or secondary air L into the refuse bed without the air having any significant contact with the underlying, adjacent grate block. Surprisingly, despite this measure, the same disadvantageous effects occur as to caking in the vicinity of the air gaps, causing the sides of the gaps to slowly grow toward each other, accompanied by scale formation and the necessity of replacing the grate blocks.

In view of the susceptibility of the slot-like air outlets to such caking, it appeared appropriate to replace these outlets by circular nozzle-like openings such as shown in FIGS. 1e and 1f. In order to supply a sufficient amount of secondary air to the burning refuse bed, openings 5c were set as low as possible in the front face of grate block 1" and every effort was made to insure a parallel flow L along the top of the adjacent grate block. However, the results still proved unsatisfactory and the redesigned air outlets became clogged with ash or non-ferrous molten metal which, naturally, led to scaling and destruction of the block.

FIGS. 1g, 1h show the next stage which was tried in which the air outlets were positioned as high as possible over the wedge-shaped depression or recess formed by the overlapping superimposition of the grate blocks. A concentration of molten slag or non-ferrous metal is to be expected in this wedge-shaped depression. The arrangement of the air outlets above the center of the grate block front tends to move the clogging-prone openings away from the problem area into a more favorable area. Even so, it would appear that air stream L, which now emerges somewhat higher in the refuse bed, should be adequate for primary ventilation.

However, it was found that ash and, in part, also molten non-ferrous metal can enter the grate block counter to flow direction L as indicated in FIG. 1g by arrow A. The concentration of foreign substances within the grate block resulting from this counter flow is indicated at 3. Here again, the flow of secondary air through the grate block and, consequently, the cooling action, is gradually diminished, leading to the previously mentioned destruction.

Figure 3A:
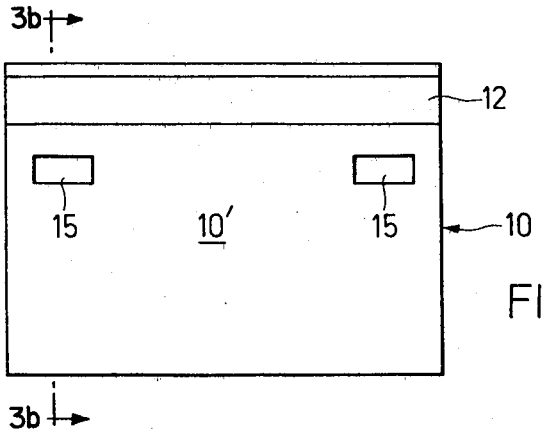
Figure 3B:
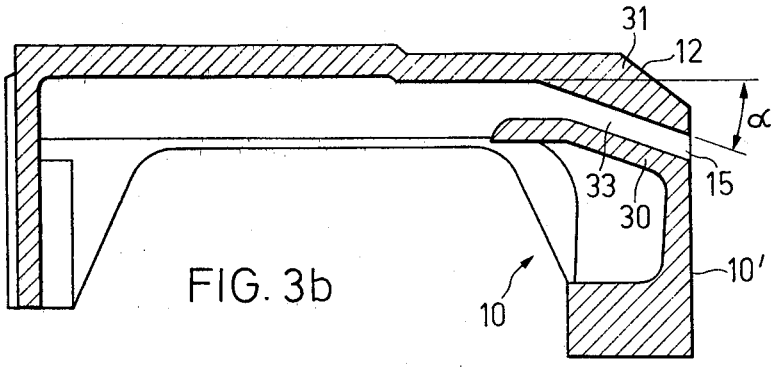

It has thus been necessary to devise a grate block which involves air flow passages which represent a substantial departure from its predecessors. A grate block in accordance with the invention is illustrated in FIGS. 3a and 3b, FIG. 3a showing a front view of a grate block 10 having two rectangular blow-out openings 15 as well as a frontal bevel or chamfer 12, best seen in FIG. 3b. It has been found that various dimensional relationships in the positioning of openings 15 in the face 10' of the block, below chamfer 12, are significant. In connection with these, the following terms will be employed, these being illustrated in FIG. 4a:

$d_1$ is the larger dimension of the blow-out opening 15;

$d_2$ is the smaller dimension of opening 15;

$L_1$ is the larger dimension of the front face 10' not including the chamfer;

$L_2$ is the smaller dimension of the front face 10';

f is the cross-sectional area of the opening 15; and

F is the total surface area of the front face.

The following relationships are then to be observed in arranging the air passages:

$$L_1:L_2 < d_1:d_2 \quad (1)$$

when $L_1 \geqq L_2$ and $d_1 \geqq d_2$;and $$20 \leqq n/2F:nf \leqq 40, \quad (2)$$

where n is a positive integer.

Figures 4A, 4B, 4C:
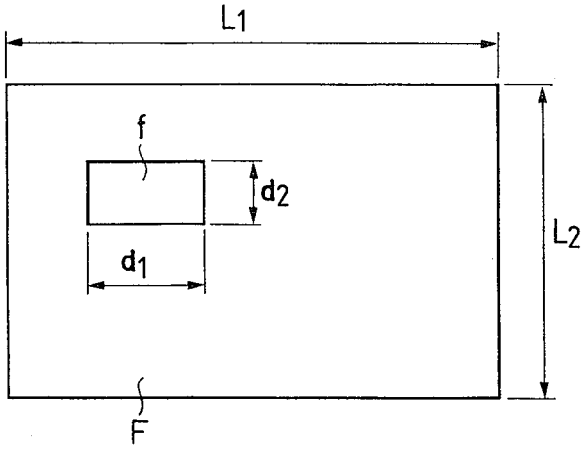

The field of the front face 10' can then be visualized as being divided into a plurality of rectangular zones or sub-fields in accordance with the following expression:

$$L_{1(1-i)} \times L_{2(1-j)} = kY_{ij} \quad (3)$$

wherein i and j are equal positive integers. These subfields are illustrated in FIGS. 4b, 4c.

In a preferred embodiment, $L_1:L_2 \simeq 1.7$ for a block in which $L_1 \simeq 206$ mm;

$d_1:d_2 \simeq 2.2$;

(nF/2):nf has a value between about 34 and 38; and $n=2$.

Almost without exception, the arrangement of two blow-out openings, one each in zone $Z_{11}$ and $Z_{14}$, as shown in FIG. 4b, proved satisfactory with dimensions selected in accordance with the foregoing relationships. Still usable results occurred using blocks constructed with openings in zones $Y_{11}$ and $Y_{13}$ and illustrated in FIG. 4c, but it was found that the success was somewhat dependent upon the position of the opening on the front face. FIGS. 4b and 4c are to be understood as illustrating a uniform distribution of the front face formed by the rectangle having sides $L_1$ and $L_2$, the designation $Z_{11}$ meaning a 1/16 part at the upper left hand corner thereof and $Z_{14}$ meaning the 1/16 part of the field at the upper right corner. $L_1$ and $L_2$ are subdivided each into four equally large portions. The division illustrated in FIG. 4c with the $Y_{ij}$ zones is somewhat less restrictive, this division into three portions given larger fields for the positioning of blow-out openings. Outside fields $Y_{11}$ and $Y_{13}$, the arrangement of the blow-out openings increasingly leads to the aforementioned difficulties wherein the long-term stability of the grate blocks starts to deteriorate.

An additional feature of the structure of the invention for preventing the penetration of ash and molten metal through the blow-in openings into the interior of the grate block is shown in FIG. 3b. In that block, a web 30 extends inwardly at an inclination from opening 15 and a correspondingly inclined parallel roof surface 31 is formed to define a downwardly, outwardly sloping blow-out channel 33 whose slope in this example, and with reference to the given dimensioning, forms an angle $\alpha$ between about 15° and about 25° relative to the upper surface of the grate block. The angle must be determined in such a way that the outflowing primary air just misses the lower adjacent grate block which is positioned in front of the opening. This condition is illustrated in FIG. 2 wherein the stream L, shown in dash-dot lines, emerges from channel 33 through opening 15 and by-passes the upper chamfered portion of the next adjacent block.

As further illustrated in FIG. 2, the blocks 10 are mounted on bearing means 11 which are supported on supports 8 and 9, the blocks being rotatable relative to supports 11. Tie rods 7 are provided to support the blocks and are coupled together so that the blocks are movable in groups and are combined together perpendicular to the longitudinal direction of the grate assembly. Reference numeral 6 designates the necessary retaining clips. Blow-out channel 33 terminates at blow-out opening 15, providing an air stream L which widens, as mentioned before, and is directed away from the opening which without the deflection action of a refuse bed located on the grate, extends just above the edge of chamfer 12. The line H is a horizontal, perpendicular to the force of gravity, showing the approximate inclination of the grate path. As a result of the high pressure drop produced during the discharge of the primary air, the previously described selection of the cross-sectional area of the air outlets permits a combustion air distribution which is, to a greater or lesser extent, independent of the refuse layer thickness over the grate surface covered with refuse, leading to a relatively uniform combustion pattern. As part of the control loop, the grate must have good conveying and stirring characteristics on the one hand and, on the other, ensure a uniform combustion pattern, a very important part being played by the cooling and previously mentioned pressure drop.

While certain advantageous embodiments have been chosen to illustrate the invention, it will be understood by those skilled in the art that various changes and modifications can be made therein without departing from the scope of the invention as defined in the appended claims.

What is claimed is:

1. A grate block for an incinerator grate with a plurality of partially overlapping grate blocks, the grate block comprising:

a body having a generally rectangular and planar front face, said front face having a first length, a first width and a first area;

air means coupled to said body for supplying forced air for cooling and for primary combustion means; and a plurality of blow-out channels in said body in fluid communication with said air means, said channels conducting forced air through and out of said body, each of said channels terminating in a generally rectangular opening extending through said front face, each said opening having a second length, a second width and a second area;

in which $$L_1 \geqq L_2,$$

$$d_1 \geqq d_2,$$

$$L_1{:}L_2 < d_1{:}d_2, \text{ and}$$

$$20 \leqq n/2F{:}nf \leqq 40,$$

where $L_1$=said first length,
$L_2$=said first width,
$d_1$=said second length,
$d_2$=said second width,
n=number of said openings,
F=said first area, and
f=said second area;

whereby the ratio of the dimensions of the face is smaller than the ratio of the dimensions of each opening, and the ratio of half the face area to an opening area is between 20 and 40.

2. A grate block according to claim 1 wherein said front face is divided into a plurality of sub-fields by a grid, said grid comprising horizontal lines separated by a vertical distance and vertical lines separated by a horizontal distance, in which said horizontal distance$=L_1/i$,
said vertical distance$=L_2/j$, and
$i=j$ where i and j are positive intergers; and wherein each of said openings is within one of said sub-fields.

3. A grate block according to claim 2 wherein said openings are only located in two of said sub-fields, the remaining sub-fields being free of openings.

4. A grate block according to claim 2 wherein $$34 \leqq F/2f \leqq 38; \text{ and}$$

wherein said openings are located in said sub-fields in upper corners of said front face.

5. A grate block according to claim 4 wherein said body has a top surface; and each of said channels is inclined at an acute angle relative to said top surface.

6. A grate block according to claim 5 wherein said acute angle is between about 15° and about 25°.

7. A grate block according to claim 1 wherein said body has a top surface; and each of said channels is inclined at an acute angle relative to said top surface.

8. A grate block according to claim 7 wherein said acute angle is between about 15° and about 25°.

9. A grate block according to claim 1 wherein $n=2$; and $20 \leqq F/2f \leqq 40$.

10. An incinerator grate comprising a plurality of partially overlapping grate blocks, each of said grate blocks including:

a body having a generally rectangular and planar front face, said front face having a first length, a first width and a first area;

air means coupled to said body for supplying forced air for cooling and for primary combustion means; and a plurality of blow-out channels in said body in fluid communication with said air means, said channels conducting forced air through and out of said body, each of said channels terminating in a generally rectangular opening extending through said front face, each said opening having a second length, a second width and a second area;

in which $$L_1 \geqq L_2,$$

$$d_1 \leqq d_2,$$

$$L_1:L_2 < d_1:d_2, \text{ and}$$

$$20 \leqq n/2F:nf \leqq 40,$$

where $L_1$=said first length, $L_2$=said first width, $d_1$=said second length, $d_2$=said second width, n=number of said openings, F=said first area, and f=said second area;

whereby the ratio of the dimensions of the face is smaller than the ratio of the dimensions of each opening, and the ratio of half the face area to an opening area is between 20 and 40.

11. An incinerator grate according to claim 10 wherein each of said bodies has a top surface; and each of said channels is inclined downwardly at an acute angle relative to the respective surface.

12. An incinerator grate according to claim 11 wherein each of said channels emits a stream of air which passes over and by-passes an adjacent one of said grate blocks.

13. An incinerator grate according to claim 11 wherein said acute angle is between about 15° and about 25°.

14. An incinerator grate comprising a plurality of partially overlapping grate blocks, each of said grate blocks including:

a body having a generally rectangular and planar front face and a top surface;

air means coupled to said body for supplying forced air for cooling and for primary combustion means; and a plurality of blow-out channels in said body in fluid communication with said air means, said channels conducting forced air through and out of said body, each of said channels being inclined downwardly at an acute angle relative to said top surface and terminating in a generally rectangular opening extending through said front face such that each of said channels emits a stream of air passing over and by-passing an adjacent one of said grate blocks.

15. An incinerator grate according to claim 14 wherein said acute angle is between about 15° and about 25°.

16. An incinerator grate according to claim 14 said openings are located in upper corners of said front face.

* * * * *